US012687170B2

(12) United States Patent
Müller et al.

(10) Patent No.: US 12,687,170 B2
(45) Date of Patent: Jul. 21, 2026

(54) VALVE PUMP UNIT

(71) Applicant: Vitesco Technologies GmbH, Regensburg (DE)

(72) Inventors: Marius Müller, Darmstadt (DE); Sebastian Brettner, Burglengenfeld (DE); Manuel Dillinger, Kelheim (DE); Markus Feulner, Ensdorf (DE); Gerhard Eser, Hemau (DE); Karl Martin Fritsch, Frankfurt (DE); Christof Heeger, Hessen (DE); Konstantin Bart, Bad Nauheim (DE)

(73) Assignee: Vitesco Technologies GmbH, Regensburg (DE)

( * ) Notice: Subject to any disclaimer, the term of this patent is extended or adjusted under 35 U.S.C. 154(b) by 0 days.

(21) Appl. No.: 18/843,924

(22) PCT Filed: Mar. 2, 2023

(86) PCT No.: PCT/EP2023/055326

§ 371 (c)(1),
(2) Date: Sep. 4, 2024

(87) PCT Pub. No.: WO2023/166127

PCT Pub. Date: Sep. 7, 2023

(65) Prior Publication Data

US 2026/0009387 A1 Jan. 8, 2026

(30) Foreign Application Priority Data

Mar. 4, 2022 (DE) ..... 10 2022 202 217.3

(51) Int. Cl.

| | |
|---|---|
| ***F04D 13/06*** | (2006.01) |
| ***F04D 1/06*** | (2006.01) |
| ***F04D 15/00*** | (2006.01) |

(52) U.S. Cl.
CPC ..... *F04D 13/0686* (2013.01); *F04D 1/06* (2013.01); *F04D 15/0005* (2013.01)

(58) Field of Classification Search
CPC ..... F04D 13/0686; F04D 1/06; F04D 15/0005
See application file for complete search history.

(56) References Cited

U.S. PATENT DOCUMENTS

| | | | |
|---|---|---|---|
| 3,845,623 | A | 11/1974 | Delancey |
| 5,320,507 | A | 6/1994 | Monnier |

(Continued)

FOREIGN PATENT DOCUMENTS

| | | | |
|---|---|---|---|
| CH | 395744 | A | 7/1965 |
| CN | 112879308 | A | 6/2021 |

(Continued)

OTHER PUBLICATIONS

English Translation DE-102017208134-A1 (Year: 2018).*

(Continued)

*Primary Examiner* — Shafiq Mian

(57) ABSTRACT

A valve/pump unit having a single electric motor for driving at least one pump stage and for adjusting a multiway valve, a reduction gearbox, which is driven by the electric motor, at least one first pump stage which is driven by the electric motor for conveying a heat transport medium in a first heat transport medium circuit, an adjustable multiway valve that is adjusted via the reduction gearbox, and having heat transport medium channels for providing at least two switching positions between the first heat transport medium circuit and a second heat transport medium circuit. In pumping operation in a first direction of rotation of the electric motor, the reduction gearbox is uncoupled from the electric motor via a freewheel. The reduction gearbox is operated in a second direction of rotation of the electric motor, opposite to the pumping operation, to adjust the multiway valve.

17 Claims, 4 Drawing Sheets

(56) References Cited

U.S. PATENT DOCUMENTS

| | | | | |
|---|---|---|---|---|
| 6,454,543 | B1 * | 9/2002 | Beck | F04B 17/03 417/423.1 |
| 2006/0216166 | A1 | 9/2006 | Pawellek | |
| 2021/0140435 | A1 | 5/2021 | Blad | |
| 2023/0118870 | A1 | 4/2023 | Eser et al. | |
| 2023/0120643 | A1 | 4/2023 | Eser | |

FOREIGN PATENT DOCUMENTS

| | | | | |
|---|---|---|---|---|
| DE | 1528798 | U | 1/1954 | |
| DE | 1050288 | B | 2/1959 | |
| DE | 2107000 | A1 | 8/1972 | |
| DE | 69223374 | | 1/1998 | |
| DE | 19925986 | A1 | 12/2000 | |
| DE | 102006051120 | A1 | 4/2008 | |
| DE | 102017208134 | A1 * | 11/2018 | F04D 13/028 |
| DE | 102018220150 | A1 | 5/2020 | |
| DE | 202019106394 | U1 | 2/2021 | |
| DE | 102020207028 | A1 | 12/2021 | |
| DE | 102020207925 | A1 | 12/2021 | |
| DE | 102020207927 | A1 | 12/2021 | |
| DE | 102020121163 | A1 | 2/2022 | |
| DE | 102022202216 | A1 | 9/2023 | |
| DE | 102022202217 | A1 | 9/2023 | |
| EP | 2163764 | A2 | 3/2010 | |
| EP | 2884107 | A2 | 6/2015 | |
| EP | 3376036 | A1 | 9/2018 | |
| EP | 3376051 | A1 | 9/2018 | |
| FR | 2891880 | A1 | 4/2007 | |
| JP | 2011052632 | A | 3/2011 | |
| JP | 2018197526 | A | 12/2018 | |
| WO | 2006122906 | A1 | 11/2006 | |
| WO | WO-2018167047 | A1 * | 9/2018 | F04D 29/486 |

OTHER PUBLICATIONS

English Translation WO-2018167047-A1 (Year: 2018).*

European Search Report dated Jun. 13, 2023 for corresponding European Patent Application No. PCT/EP2023/055326.

German Search Report dated Oct. 28, 2022 for corresponding German Patent Application No. 10 2022 202 217.3.

* cited by examiner

VALVE PUMP UNIT

CROSS-REFERENCE TO RELATED APPLICATIONS

This application claims priority to PCT Application PCT/EP2023/055326, filed Mar. 2, 2023, which claims priority to German Patent Application No. DE 10 2022 202 217.3, filed Mar. 4, 2022. The disclosures of the above applications are incorporated herein by reference.

FIELD OF THE INVENTION

The present invention relates to a valve/pump unit, such as for a heat transport medium system of a vehicle, a heat transport medium system having such a valve/pump unit and a vehicle having such a valve/pump unit.

SUMMARY OF THE INVENTION

It is an object of the present invention to improve a heat transport medium system of a vehicle. A further object is to simplify such a heat transport medium system.

A valve/pump unit is proposed. This valve/pump unit has:

- a single electric motor for driving at least one pump stage and for adjusting a multiway valve,
- a reduction gearbox, which is driven by the electric motor,
- at least one first pump stage which is driven by the electric motor for carrying a heat transport medium in a first heat transport medium circuit,
- a multiway valve that is adjusted via the reduction gearbox and has heat transport medium channels for providing at least two switching positions between the first heat transport medium circuit and a second heat transport medium circuit of a heat transport medium system, and
- a common housing section for accommodating the electric motor, the multiway valve, the reduction gearbox and the pump stage.

In pumping operation, in a first direction of rotation of the electric motor, the reduction gearbox is uncoupled from the electric motor via a freewheel.

And the reduction gearbox may be operated in a second direction of rotation of the electric motor, opposite to the pumping operation, to adjust the multiway valve.

The proposed valve/pump unit represents an integration of multiple components of such an aforementioned heat transport medium circuit in one unit or one core module.

This is also associated with a reduction in the components required to operate such a heat transport medium circuit. Since such components are saved, such a heat transport medium circuit or a heat transport medium system having such a heat transport medium circuit is simplified.

By using such a highly integrated valve/pump unit (in the sense of a core module), weight, installation space and costs are also saved.

According to a further embodiment, the multiway valve is joined to the electric motor in such a way that the multiway valve encloses the electric motor, for example annularly.

At least one internal contour of the multiway valve that encloses the electric motor is designed to be at least substantially circular.

Additionally or alternatively, an external contour of the multiway valve is designed to be at least substantially circular.

The multiway valve may thus have an at least substantially annular shape and surround the electric motor annularly or at least substantially annularly.

The multiway valve is designed to be circumferentially closed. Such a closed circumferential structure offers increased structural rigidity as compared with an open structure.

According to a further embodiment, the multiway valve has at least one (valve) section having individual channel sections that is fixed relative to the common housing section, and at least one (valve) section having individual channel sections that is pivotable relative to the common housing section, via which the aforesaid switching positions of the multiway valve are adjustable between the first heat transport medium circuit and the second heat transport medium circuit of the heat transport medium system.

The heat transport medium channels of the multiway valve or its individual (valve) sections forming the heat transport medium channels extend between the common housing section and the electric motor.

According to one embodiment, the multiway valve is designed in the form of a 4/2-way valve. This permits the previously described multi-part nature of the multiway valve also to be depicted by combinations of valves by a corresponding configuration of individual valve sections—with associated channel sections—for example a combination of a 4/2-way valve with a 3/2-way valve.

According to a further embodiment, the valve/pump unit additionally has a second pump stage for conveying the heat transport medium in the second heat transport medium circuit. It is proposed to accommodate this pump stage—at least indirectly—by the common housing section as well in order to increase the integration density of the valve/pump unit.

According to a further embodiment, a clutch which connects the electric motor and the second pump stage releasably to each other is arranged between the electric motor and the second pump stage. The clutch is designed in the form of an opening clutch, for example a centrifugal force clutch, via which the second pump stage may be uncoupled or released. Alternatively, this clutch may also be designed as a closing clutch, for example in the form of a centrifugal force clutch, via which the second pump stage is coupled up.

Such a clutch makes it possible as necessary to operate only the first heat transport medium circuit or to convey the heat transport medium only in the first heat transport medium circuit, for example for the fast charging of a battery of the first heat transport medium circuit.

Alternatively, in a further embodiment, such a clutch is omitted, so that the two pump stages are connected permanently to each other.

According to a further embodiment, the electric motor is designed as a dry-running motor.

According to a further embodiment, the first pump stage (PS1) and/or the second pump stage (PS2) is/are designed in the form of a radial pump stage.

However, the pump stages may also be designed as flow pump (stages) or as displacement pump (stages).

Also proposed is a heat transport medium system having a valve/pump unit of the previously described type for a vehicle, having a first heat transport medium circuit and a second heat transport medium circuit, wherein the valve/pump unit is provided and arranged between the two circuits.

Also proposed is a vehicle having a valve/pump unit of the previously described type or a heat transport medium system of the previously described type.

Also described is an operating method for a valve/pump unit of the previously described type, in which the electric motor is operated in the first direction of rotation to drive the at least one pump stage and to drive the reduction gearbox in the second direction of rotation, opposite to the pumping operation, to adjust the multiway valve. In pumping operation, the reduction gearbox is uncoupled from the electric motor via the freewheel.

According to one embodiment, in pumping operation the first pump stage and the second pump stage are driven by the electric motor. In pumping operation, above a specific rotational speed of the electric motor,—depending on the design of the coupling—the second pump stage is uncoupled or released via the clutch, for example in the form of an opening centrifugal force clutch, or coupled up, for example in the form of a closing centrifugal force clutch.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention is explained in detail below with reference to the illustrations in the figures. Further developments of the invention can be found in the following description of preferred embodiments. In this respect.

DETAILED DESCRIPTION OF THE PREFERRED EMBODIMENTS

The following description of the preferred embodiment(s) is merely exemplary in nature and is in no way intended to limit the invention, its application, or uses.

Figure 1:
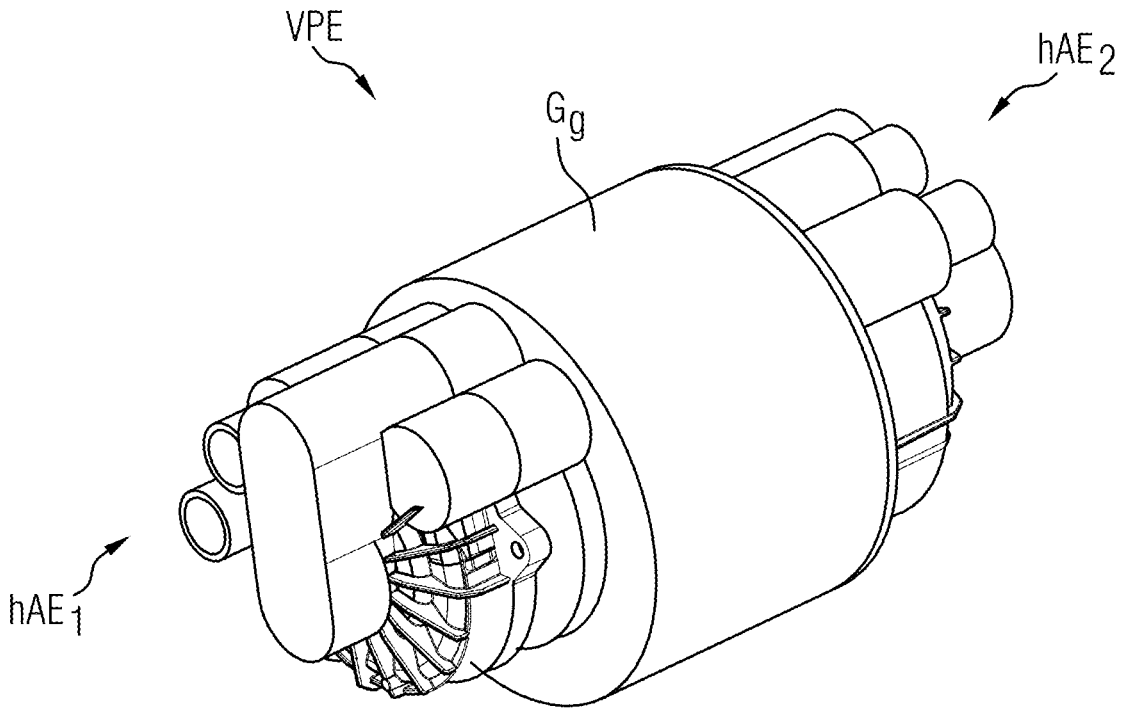
FIG. 1 shows a perspective view of a valve/pump unit.

FIG. 1 illustrates a proposed substantially cylindrical valve/pump unit VPE, which is attached or connected hydraulically via a first connection end $hAE_1$ to a first heat transport medium circuit (or cooling circuit) and hydraulically via a second connection end $hAE_2$ to a second heat transport medium circuit (or cooling circuit) of a heat transport medium system (or thermal management system) of a vehicle.

This valve/pump unit VPE provides two selective switching positions of a multiway valve MWV in the shape of a 4/2-way valve between the first circuit and the second circuit.

Figure 2:
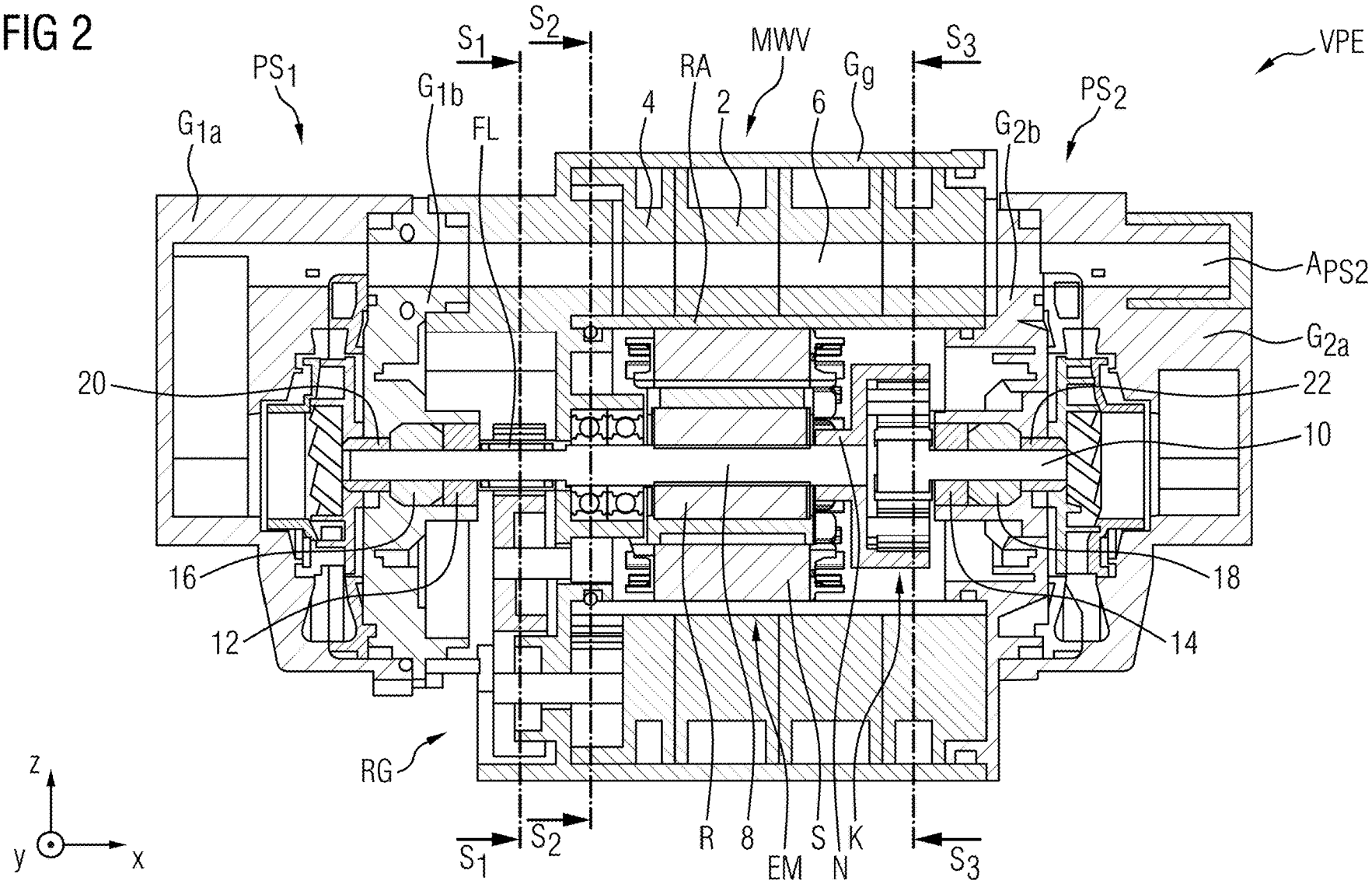
FIG. 2 shows the valve/pump unit shown in FIG. 1 in a sectional view.
Figure 3:
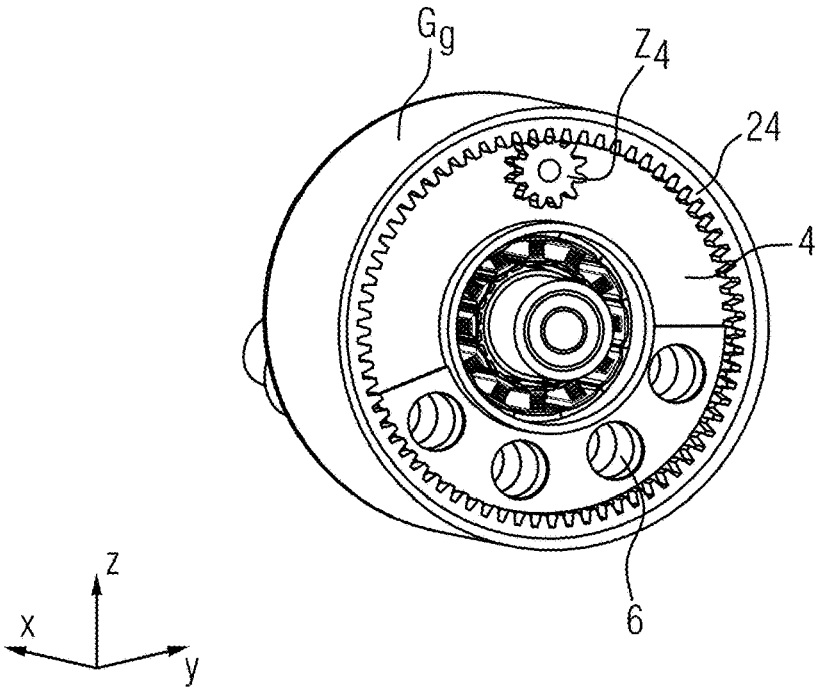
FIG. 3 shows a perspective sectional view with respect to the section line $S_1$-$S_1$ in FIG. 2.

FIG. 2 illustrates which components of the first and second circuit are integrated into this valve/pump unit VPE by a common housing section Gg. The housing section Gg thus has a centrally supporting and integrating function.

A single electric motor or E-motor EM designed as an internal rotor and a dry-running motor is joined to the multiway valve MWV in such a way that the multiway valve MWV encloses the E-motor EM annularly—for example completely or in a circumferentially closed manner—within the common housing section Gg. The E-motor EM forms a central or centrally driving component of the valve/pump unit VPE.

The stator S of the E-motor EM is arranged within a tubular section RA or an at least tube-like section RA, wherein this tubular section RA is sealed off adequately with respect to its periphery in a respectively associated area and thus forms a dry space for the stator S in the rotor R of the electric motor EM within the tubular section RA.

The multiway valve MWV joined to the tubular section RA has at least one section 2 that is fixed relative to the housing section Gg and at least one section 4 that is pivotable relative to the housing section Gg in a first or a second direction of rotation of the E-motor EM. Heat transport medium channels 6 (or liquid channels 6) in the multiway valve MWV extend between the housing section Gg and the E-motor EM.

The outer circumferential side of the individual sectors 2, 4 of the multiway valve MWV is cut away in some sections to save weight and, in conjunction with the common housing section Gg, form individual cavities, in which conveyed fluid or conveyed liquid may collect (FIG. 2).

The valve/pump unit VPE has a first pump stage $PS_1$, for example in the form of a flow pump stage, for example in the form of a radial pump stage, and a second pump stage $PS_2$, for example in the form of a radial pump stage, which are each drivable via a drive shaft 8 of the E-motor EM.

The two pump stages $PS_1$, $PS_2$ each have at least a first and second housing section $G_{1a}$, $G_{1b}$ and $G_{2a}$, $G_{2b}$. The two housing sections $G_{1b}$, $G_{2b}$—which as such face the common housing section Gg—are joined to the housing section Gg or accommodated by the latter.

A three-stage reduction gearbox RG for the selective adjustment of the multiway valve MWV is, for example, provided and arranged between the pump stage $PS_1$ and the E-motor EM. The sectional illustration in FIG. 4 (corresponding to a section through the section line or plane $S_1$-$S_1$ in FIG. 2) illustrates the gear wheels $Z_1$, $Z_2$, $Z_3$ of the first and second gearbox stage, and the sectional illustration in FIG. 2 (corresponding to a section through the section line or plane $S_2$-$S_2$ in FIG. 2) illustrates the gear wheel $Z_4$ of the fourth gearbox stage. The gear wheel $Z_4$ meshes with internal toothing 24 formed on the pivotable section 4 of the multiway valve MWV, so that the section 4 functions with the effect of a ring gear, which is pivoted selectively via the gear wheel $Z_4$. In the present embodiment of the reduction gearbox RG, the section 4 pivots in a direction of rotation of the E-motor EM which corresponds to the pumping operation of the E-motor EM. In an alternative embodiment of the reduction gearbox RG, however, the section 4 may also pivot in a direction of rotation of the E-motor EM which is opposite to that in pumping operation.

Figure 4:
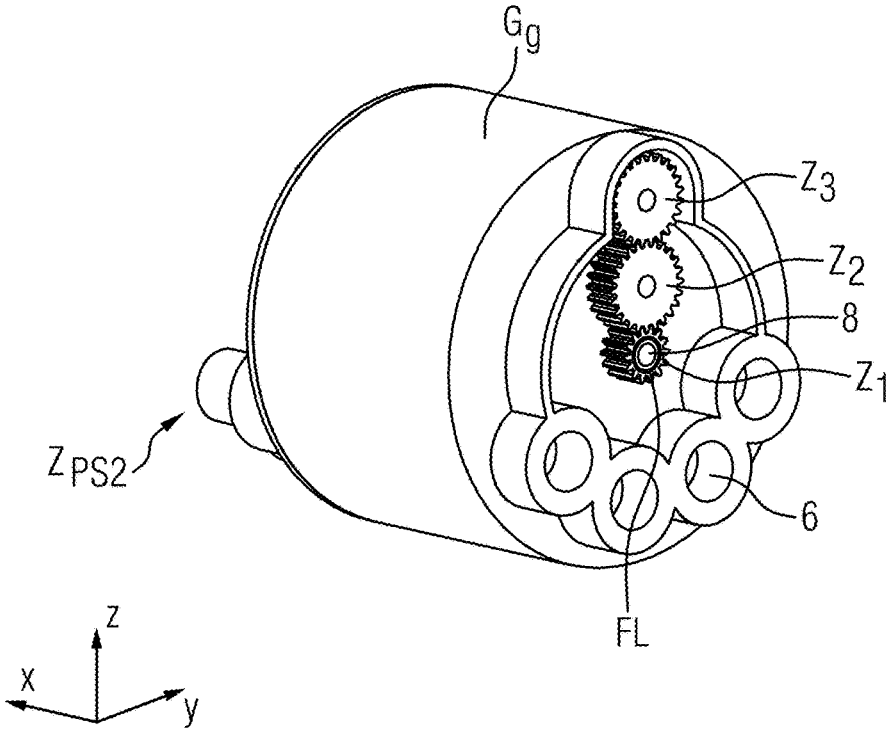
FIG. 4 shows a perspective sectional view with respect to the section line $S_2$-$S_2$ in FIG. 2.

Provided and arranged between the drive shaft 8 and the gear wheel $Z_1$ is a freewheel FL—for example in the form of a clamping roller freewheel—which transmits torque to the reduction gearbox RG only in a direction of rotation that is opposite to the pumping operation of the electric motor EM, and thus permits the selective adjustment of the multiway valve MWV into at least two switching positions (FIG. 4, FIG. 2). Alternatively, the freewheel FL could also be arranged at a different point of the reduction gearbox RG.

In the direction of the pump stage $PS_1$ the drive shaft 8 extends through a rolling-contact bearing arrangement—in the form of an overhung bearing—to accommodate the drive shaft 8 in the housing section Gg, the freewheel FL, a seal 12, a sliding bearing 16 and as far as into a metallic bush 20, e.g. a brass bush, on which the impeller of the pump stage $PS_1$ is seated.

On the other hand, in the direction of the pump stage $PS_2$ the drive shaft 8 extends into a hub section N of a centrifugal force clutch K via which the pump stage $PS_2$ is attached to the E-motor EM. On the drive slide, a drive shaft 10 extends from this centrifugal force clutch K through a seal 14, a sliding bearing 18 and as far as into a metallic bush 22, e.g. a brass bush, on which the impeller of the pump stage $PS_2$ is seated. The centrifugal force clutch K is designed in the sense of an opening clutch which, starting from a specific rotational speed of the drive shaft 8, opens and as a result releases the operative connection of the E-motor EM to the pump stage $PS_2$. Thus, in pumping operation, if necessary in a corresponding operating mode of the E-motor EM, the pump stage $PS_2$ is uncoupled or released by the centrifugal force clutch K.

The centrifugal force clutch K is arranged within the tubular section RA between the E-motor and the pump stage $PS_2$. The two seals 12, 14 contribute to keeping the reduction gearbox RG, the centrifugal force coupling K and the E-motor EM dry.

Figure 5:
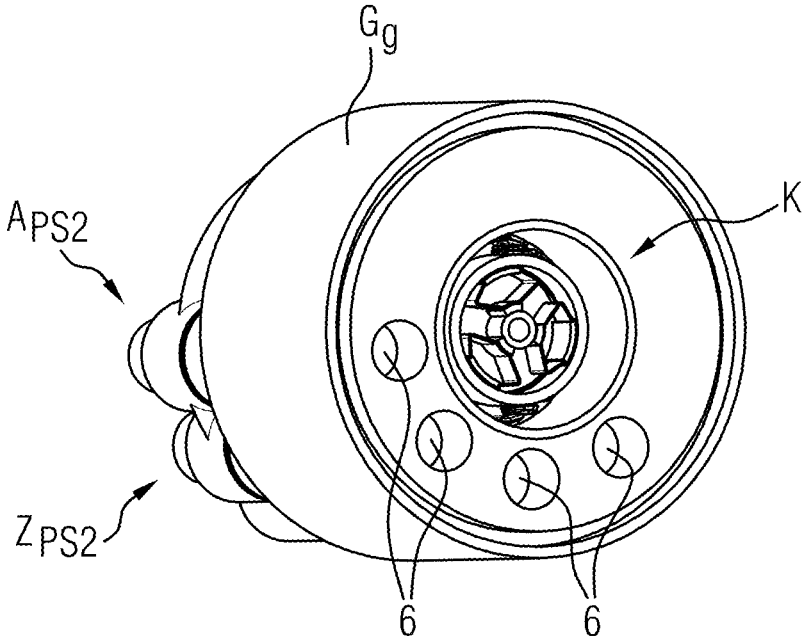
FIG. 5 shows a perspective sectional view with respect to the section line $S_3$-$S_3$ in FIG. 2.
Figure 6:
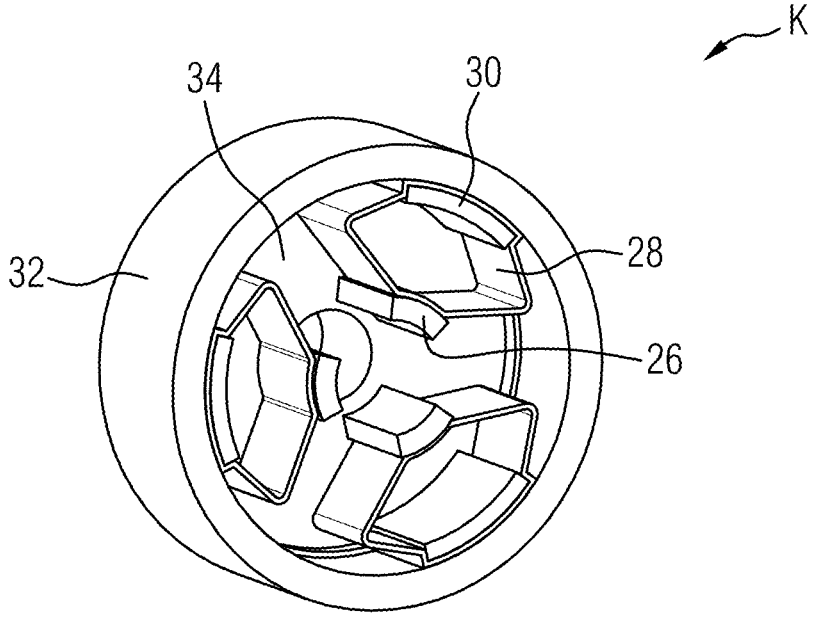
FIG. 6 shows an enlarged view of the clutch shown in FIG. 5.

The sectional illustrations in FIGS. 5, 6 (corresponding to a section through the section line or plane $S_3$-$S_3$ in FIG. 2) illustrate the aforesaid centrifugal force clutch K, which includes a closed revolving disk section 34 molded on the hub section N and a closed revolving ring section 32 molded on the disk section 34. Molded on the front face of the disk section 34 in addition are three arcuate claws 30 spaced apart uniformly from one another in the circumferential direction of the centrifugal force clutch K to accommodate a closed revolving spring element 28.

With respect to their extent in the circumferential direction of the centrifugal force clutch K, these claws 30 are spaced apart radially relative to the ring section 32 in such a way that, with the ring section 32, they form an arcuate gap, into which an associated spring element 28 is inserted.

Radially on the inner side, each of these spring elements 28 carries what is known as a clutch lining element 26, which is molded so as to correspond or be complementary to the section of the driveshaft 10 illustrated in FIG. 5. This clutch lining element 26 may be an element composed of a suitable frictional and bonding element or else an element including such a frictional and bonding element. The clutch lining element 26 may also be formed from an elastomer or else include such an elastomer. The clutch lining element 26 forms a form and force fit with the aforesaid output shaft section (FIG. 5).

In a further embodiment—not illustrated here—it is proposed to design the clutch in the form of a closing centrifugal force clutch.

The E-motor EM of the valve/pump unit VPE is operable in two directions of rotation:

a) in a first direction of rotation in the aforesaid pumping operation, and b) to drive the reduction gearbox RG in a second direction of rotation, opposite to the pumping operation, to adjust the multiway valve MWV.

In pumping operation, the reduction gearbox RG is uncoupled from the E-motor EM via the freewheel FL.

The adjustment of the pivotable or rotatably adjustable multiway valve MWV is carried out step-by-step or in a staggered manner or else continuously from one switching position to another switching position of the multiway valve MWV.

In FIG. 2, one of two switching positions of the 4/2 multiway valve MWV may also be seen, in which an outlet or outlet connection $A_{PS2}$ of the pump stage $PS_2$ or of the second circuit has a fluid connection or flow connection to the pump stage $PS_1$ via an associated channel 6.

FIG. 2 illustrates a series connection of the two aforementioned circuits—i.e. of the first and second heat transport medium circuit—in which the outlet $APS_2$ has a fluid connection to a feed $Z_{PS1}$—not illustrated in FIG. 2—of the pump stage $PS_1$ or of the first circuit. The same is also true of an outlet or outlet connection $A_{PS1}$—not illustrated in FIG. 2—of the pump stage $PS_1$ or of the first circuit, which has a fluid connection to a feed $Z_{PS2}$—not illustrated in FIG. 2—of the pump stage $PS_2$ or of the second circuit.

By contrast, in a parallel connection—not illustrated here—of the two aforementioned circuits, on the one hand the outlet $A_{PS1}$ has a fluid connection to the feed $Z_{PS1}$ and on the other hand the outlet $A_{PS2}$ has a fluid connection to the feed $Z_{PS2}$, specifically each via an associated channel 6 in the multiway valve MWV. This means that conveyed fluid or conveyed liquid is accordingly redirected in the multiway valve MWV.

FIG. 5 illustrates the outlet $A_{PS2}$ and the feed $Z_{PS2}$ of the second circuit.

In addition, between this series and parallel connection of the two circuits, various mixed positions of the section 4 or the multiway valve MWV are possible. For this purpose, the multiway valve MWV may have an arrangement of appropriately formed channels 6—not illustrated here—, which bring about or effect such mixed states within the multiway valve MWV.

In a further embodiment—not illustrated here—, further freewheels may also be provided, specifically on the pump stage $PS_1$ between the metallic bush 20 and the driveshaft 8 and/or on the pump stage $PS_2$ between the metallic bush 22 and the drive shaft 10. Therefore, the conveyed fluid is not braked in the direction of rotation of the E-motor EM that is opposed to pumping operation but, instead, may continue to flow because of its mass moment of inertia.

Because of the proposed valve/pump unit, the aforementioned heat transport medium circuits or such a heat transport medium system having such heat transport medium circuits is simplified highly.

Individual, previously necessary, components are saved and, concomitantly, also weight, overall space and costs.

Although exemplary embodiments are explained in the preceding description, it should be pointed out that a large number of modifications is possible. It should be noted, furthermore, that the exemplary embodiments are merely examples which are in no way intended to limit the scope of protection, the applications, and the structure. Instead, the above description gives a person skilled in the art a guideline for the implementation of at least one exemplary embodiment, it being possible to make various changes, especially with regard to the function and arrangement of the component parts described, without departing from the scope of protection as emerges from the combinations of features that are equivalent thereto.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A valve/pump unit, comprising:

an electric motor;

a reduction gearbox, which is driven by the electric motor;

at least one first pump stage which is driven by the electric motor for conveying a heat transport medium in a first heat transport medium circuit;

an adjustable multiway valve that is adjusted via the reduction gearbox, the adjustable multiway valve further comprising:

a plurality of heat transport medium channels for providing at least two switching positions between the first heat transport medium circuit and a second heat transport medium circuit of a heat transport medium system; and a common housing section for accommodating the electric motor, the multiway valve, the reduction gearbox and the at least one first pump stage;

a single freewheel;

wherein, during a pumping operation, in a first direction of rotation of the electric motor, the reduction gearbox is uncoupled from the electric motor via the single freewheel, and the reduction gearbox is operated in a second direction of rotation of the electric motor, opposite to the pumping operation, to adjust the multiway valve.

2. The valve/pump unit of claim 1, wherein the multiway valve is joined to the electric motor in such a way that the multiway valve encloses the electric motor.

3. The valve/pump unit of claim 1, the multiway valve further comprising:

at least one section that is fixed in relation to the common housing section; and at least one section that is pivotable with respect to the common housing section in the first direction of rotation or second direction of rotation.

4. The valve/pump unit of claim 1, the plurality of heat transport medium channels further comprising individual channel sections arranged between the common housing section and the electric motor.

5. The valve/pump unit of claim 1, further comprising a second pump stage for conveying the heat transport medium in the second heat transport medium circuit.

6. The valve/pump unit of claim 5, wherein the second pump stage is also accommodated by the common housing section.

7. The valve/pump unit of claim 5, further comprising:

a clutch arranged between the electric motor and the second pump stage;

wherein the clutch releasably connects the electric motor and the second pump stage to each other.

8. The valve/pump unit of claim 7, wherein the clutch is an opening centrifugal force clutch.

9. The valve/pump unit of claim 7, wherein the clutch is a closing centrifugal force clutch.

10. The valve/pump unit of claim 5, wherein the second pump stage is a radial pump stage.

11. The valve/pump unit of claim 1, wherein the electric motor is a dry-running motor.

12. The valve/pump unit of claim 1, wherein the at least one first pump stage is a radial pump stage.

13. A heat transport medium system for a vehicle, comprising:

a first heat transport medium circuit; and a second heat transport medium circuit;

a valve/pump unit provided between the first heat transport medium circuit and the second heat transport medium circuit, the valve/pump further comprising:

an electric motor;

a reduction gearbox, which is driven by the electric motor;

at least one first pump stage which is driven by the electric motor for conveying a heat transport medium in a first heat transport medium circuit;

an adjustable multiway valve that is adjusted via the reduction gearbox, the adjustable multiway valve further comprising:

a plurality of heat transport medium channels for providing at least two switching positions between the first heat transport medium circuit and a second heat transport medium circuit of a heat transport medium system; and a common housing section for accommodating the electric motor, the multiway valve, the reduction gearbox and the at least one first pump stage;

a single freewheel;

wherein, during a pumping operation, in a first direction of rotation of the electric motor, the reduction gearbox is uncoupled from the electric motor via the single freewheel, and the reduction gearbox is operated in a second direction of rotation of the electric motor, opposite to the pumping operation, to adjust the multiway valve.

14. A vehicle comprising a heat transport medium system of claim 13.

15. An operating method for a valve/pump unit of claim 1, comprising the steps of:

operating the electric motor in the first direction of rotation to drive the at least one pump stage; and driving the reduction gearbox in the second direction of rotation, opposite to the pumping operation, to adjust the multiway valve such that during the pumping operation, the reduction gearbox is uncoupled from the electric motor via the single freewheel.

16. The operating method of claim 15, further comprising the step of driving the first pump stage and the second pump stage by the electric motor during the pumping operation.

17. The operating method of claim 15, further comprising the steps of uncoupling or coupling up the second pump stage via the clutch during pumping operation above a specific speed of rotation of the electric motor.

* * * * *